US005590484A

United States Patent [19]

Mooney et al.

[11] Patent Number: 5,590,484

[45] Date of Patent: Jan. 7, 1997

[54] UNIVERSAL MOUNT FOR RIFLE

[76] Inventors: Aurelius A. Mooney, deceased, late of Columbia, S.C.; by Virginia R. Mooney, personal representative, 304 Park Springs Rd., Columbia, S.C. 29223; Edward P. Schmitter, 1631 Fuller Rd., Blythewood, S.C. 29016; Richard Baker, 2701 W. Waters Ave., Apartment #1409, Tampa, Fla. 33614

[21] Appl. No.: 516,028

[22] Filed: Aug. 17, 1995

[51] Int. Cl.[6] ..... F41G 1/46

[52] U.S. Cl. ..... 42/100; 42/101; 42/103

[58] Field of Search ..... 42/100, 101, 103; 89/37.04; 33/361; 362/110

[56] References Cited

U.S. PATENT DOCUMENTS

| | | | |
|---|---|---|---|
| 3,368,454 | 2/1968 | Peck et al. | 42/100 |
| 4,026,054 | 5/1977 | Snyder | 42/1 A |
| 4,044,486 | 8/1977 | Van Holten | 42/101 |
| 4,494,328 | 1/1985 | Stevens | 42/1 A |
| 4,539,769 | 9/1985 | Stevens et al. | 42/1 A |
| 4,571,870 | 2/1986 | Heideman et al. | 42/1 A |
| 4,733,489 | 3/1988 | Kurak | 42/77 |
| 4,845,871 | 7/1989 | Swan | 42/101 |
| 4,926,576 | 5/1990 | Maes et al. | 42/103 |
| 5,010,676 | 4/1991 | Kennedy | 42/71.01 |
| 5,068,968 | 12/1991 | Sillery | 42/100 |
| 5,142,806 | 9/1992 | Swan | 42/101 |
| 5,198,600 | 3/1993 | E'Nama | 42/105 |
| 5,279,200 | 1/1994 | Rose | 89/14.3 |
| 5,343,650 | 9/1994 | Swan | 42/100 |
| 5,448,940 | 9/1995 | Schuetz et al. | 89/185 |

FOREIGN PATENT DOCUMENTS 2592149 6/1987 France .

*Primary Examiner*—Charles T. Jordan
*Assistant Examiner*—Meena Chelliah
*Attorney, Agent, or Firm*—Michael A. Mann, P.A.

[57] ABSTRACT

A universal mount for a rifle comprises an upper rail having a plurality of traverse ribs running from the back of the upper receiver to the gas block, and a hand guard surrounding the barrel. The hand guard has side mounts allowing the addition of accessory devices such as flashlights and laser sights. A lower rail, designed to accept a grenade launcher and a bayonet, resides between the barrel and the hand guard. A heat shield is attached to the hand guard to protect the marksman from injury. A semicircular retaining ring locks the hand guard to the gas block by means of a throughhole which matingly engages a pin located in the muzzle end of the hand guard. When in place, the present invention provides a weapons' platform which achieves and maintains continuous alignment between the sight line of any optical attachments and the direction of a barrel that has become deformed due to thermal stress. The present invention can be used alone or in conjunction with a ballistic optimization system and can be backfitted onto an existing rifle without altering its basic components.

21 Claims, 4 Drawing Sheets

30
40
160
165
170
175
180
185
190
195
197
200
210
230
232
235
240
250
270
320
325
330

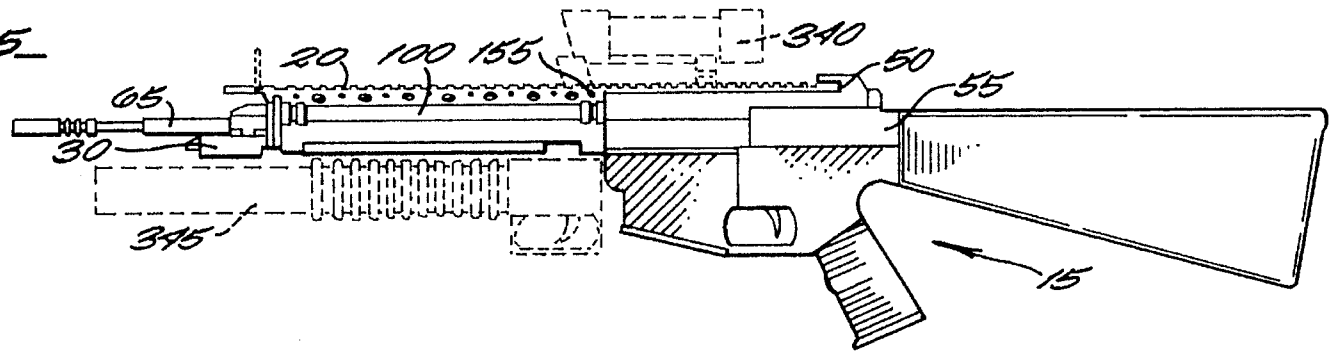
FIG. 15
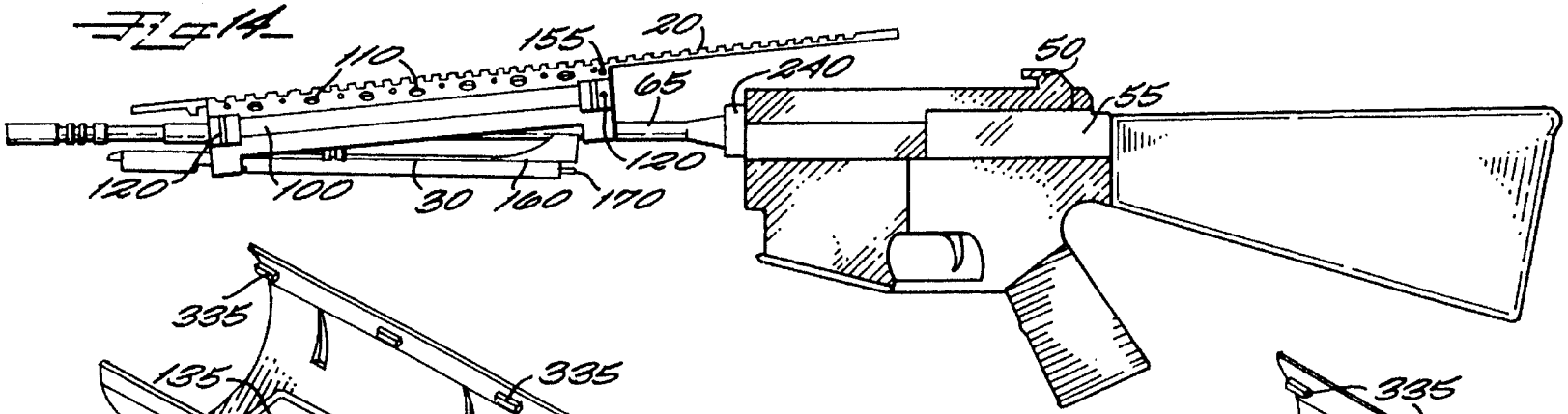
FIG. 14
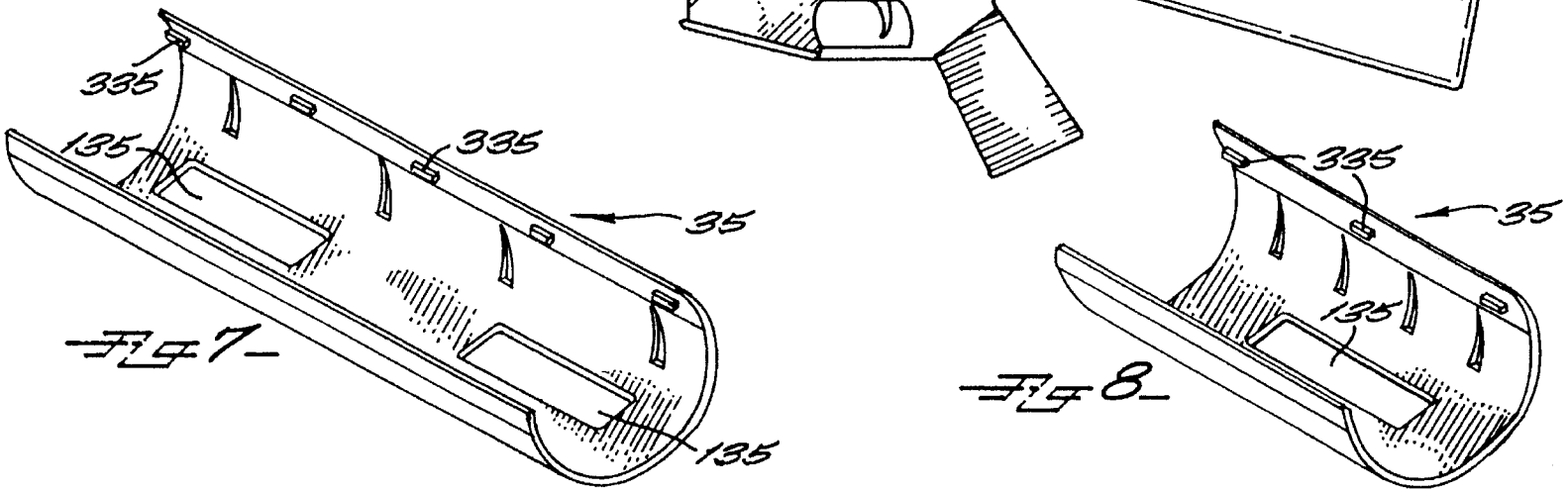
FIG. 8
FIG. 7

UNIVERSAL MOUNT FOR RIFLE

BACKGROUND OF THE INVENTION

1. Field of the Invention

The present invention relates to mounts for rifles. More specifically, the present invention relates to a mount fitted over the barrel of a rifle and formed to support a series of accessory devices simultaneously.

2. Discussion of Background

The increasing complexity of combat has resulted in a need for sophisticated weaponry with increased accuracy and multiple operational capabilities. With respect to rifles, particularly the M-16 and M-4, this need is reflected in the requirement that the rifle be able to support various accessories such as grenade launchers, infrared and night vision scopes, laser spotters and the like. Consequently, the art has responded to this requirement by generating various rifle mounts capable of holding the above mentioned accessories. What follows is a summary of the art's current state.

U.S. Pat. No. 5,343,650 teaches a multi-purpose rifle mount secured to the receiver of the rifle. The mount has a sleeve that fits over the barrel. The barrel remains "free-floating" in that the sleeve is positioned a distance from the barrel and does not contact the barrel at any point.

U.S. Pat. No. 4,845,871 sets forth a mounting attachment that is bolted to the top of the carrying handle of an M-16.

U.S. Pat. No. 5,198,600 discloses an attachment that clamps to the barrel of an M-16. Traverse slots, depending from the device, allow the securement of a singular accessory.

U.S. Pat. No. 4,026,054 mounts a sighting device to the barrel. The method of mounting is designed so as to protect the laser from recoil of the weapon.

U.S. Pat. No. 4,733,489 discloses a mount for a grenade launcher. The device attaches to the barrel of an M-16 rifle and holds the launcher underneath the barrel. After attaching the device, the original hand guard is reattached.

One problem encountered by the present art is the loss of accuracy due to thermal deformation of the barrel. When several rounds are fired over a short time period, the interior of the barrel increases in temperature. As the barrel interior heats to several hundred degrees, it loses linearity and begins to "wander" (thermally deforms) as it relieves stresses that were imparted during manufacture. Consequently, the accuracy of the weapon is compromised. This "wandering" phenomena is most noticeable when the weapon is equipped with enhanced scopes and laser devices. Most of the prior art design has such enhanced scopes and laser devices mounted to the upper receiver of the weapon. After firing several rounds, the sighting device is still "zeroed," however, the deformation of the barrel results in the round missing the target. Thus, although the weapon has been correctly aimed at the target, the barrel is no longer pointed in the correct direction. As a result, the enhanced sights and scopes, despite the quality of their optics and technology, are rendered useless and ineffective by the "wandering" of the barrel.

Therefore, there exists a need for a universal mount that can be easily attached to the barrel of a rifle, can support a plurality of accessories simultaneously, and minimizes the deleterious impact of thermal deformation of the barrel.

SUMMARY OF THE INVENTION

The present invention is a universal mount comprising an upper rail, a lower rail, a heat shield, and a retaining clip.

The mount can be backfitted onto an existing M-16 or M-4 rifle without altering any major components of the weapon. Alternatively, the mount may be incorporated into the weapon during manufacture. The present invention may be used alone or in conjunction with the ballistic optimizing system manufactured by Browning Corporation. When in place, the present invention enables the rifle to be used as a weapons' platform, simultaneously supporting a plurality of accessory devices that enhance the operational capabilities of the weapon.

The upper rail runs from the rear of the upper receiver to the gas block of the barrel. Extending from the upper rail is a plurality of equally spaced, transverse ribs. Commonly referred to as a "Picatinny Rail", these transverse ribs provide a means for attaching a variety of different sights and scopes. Additionally, the upper rail contains a front and rear sight which rotate about respective pivot points between an in-use or operative position and a folded or stored position. When in the stored position, the front and rear sights may be rotated to become co-planer with the upper rail.

A hand guard depends from the upper rail and surrounds the barrel of the weapon. The hand guard is spaced apart from the barrel and contains an array of heat dispersing holes. The interior of the hand guard contains projections that allow engagement with the gas block and rear mount, thereby aligning the device and preventing rotation. Formed along both the front and rear sides of the hand guard and extending therefrom, are side mounts allowing the attachment of additional accessories such as flashlights, laser pointers, etc. When in use, these mounts provide four additional locations for the attachment of devices. A through hole located at the bottom of the hand guard allows attachment of the lower rail. A heat shield, which protects the hands of the user from barrel heat, is secured to the hand guard by means of internal projections that matingly engage slots formed in the sides of the hand guard. The lower rail is positioned horizontally between the bottom of the hand guard and the barrel of the weapon and contains slots for the attachment of an M-203 grenade launcher, for example. A bayonet mount extends horizontally from the front of the lower rail.

In the case of an existing M-16 or M-4 rifle that is to be equipped with the present universal mounting device, the following modifications are made to the basic rifle. The existing hand guards are removed. The carrying handle is machined off except for a small portion at the very rear of the upper receiver, which is notched. This notch receives the end of the upper rail. The existing barrel nut and gas block are removed. A rear block having a first set of axial grooves and a new barrel nut having a counter bore are added to the receiver end of the barrel. A new gas block having a second set of axial grooves and a circumferential groove is added to the muzzle end of the barrel.

Aligning the axial grooves of the rear block is accomplished by placing the top rail of the universal mount over the barrel, sliding the hand guard over the gas block and the rear block, and rotating the rear block as necessary to align the axial grooves of the rear block with the internal projections of the hand guard. When in place, the rear mount is pinned to the barrel nut, through clearance holes located in the hand guard, thereby providing a secure alignment.

When in position between the hand guard and the barrel, the lower rail is held in place by a collar which partially wraps around the barrel and seats in the counter bore of the barrel nut. Also located at the receiver end of the lower rail is a pin that fits between the projections of the barrel nut and prevents rotation of the lower rail. A spring pin, located toward the muzzle end of the lower rail, engages the hand guard of the upper rail and forces the collar against the counter bore of the barrel nut.

To install the universal mount, the upper rail is slid part way onto the barrel, far enough for the receiver end of the hand guard to clear the gas block but not far enough for it to reach the rear block. The lower rail is then inserted in the throughhole at the bottom of the hand guard, and the collar of the lower rail fitted over the barrel and moved rearwardly into the counter bore, with the rear pin residing between the two lowermost projections of the barrel nut. The hand guard is then moved so that it is seated on both the rear block and the gas block, and the spring pin of the lower rail is in position against the hand guard. The hand guard is thereafter pushed back toward the receiver so that it is just clear of the circumferential groove of the gas block. A semicircular ring is slipped into that groove, forward of the hand guard. A spring pin, located in one of the side mounts of the hand guard, matingly engages a hole located in the semicircular ring, thereby preventing the hand guard from moving in the forward direction.

A major feature of the present invention is that it is secured to the barrel so that the universal mount "follows" the direction of the barrel when the latter undergoes thermal deformation as a result of firing successive rounds of ammunition. Because the retaining pin secures the hand guard to the gas block, the universal mount will move in the same direction as the barrel, thereby ensuring that the direction of the barrel coincides with the sight line of the scopes and sighting devices. This feature enables the weapon to remain accurate despite the number of rounds fired or the temperature of the barrel..

Another important feature of the present invention is the method by which the device is attached to the barrel. The axial grooves of both the rear mount and the gas block are aligned by first sliding one end of the hand guard onto the gas block and then rotating the rear mount so that its axial grooves align with and receive the projections of the other end of the hand guard. Thereafter, the rear mount is pinned to the rifle to secure it. This attachment is simple but very secure. Furthermore, once attached, the device remains aligned with the underlying weapon and with the accessories attached to it. Moreover, once the rear mount is pinned to the rifle barrel, the universal mount may be removed and replaced as often as necessary without adversely influencing the alignment of gas block and rear mount.

Still another feature of the present invention is the small number and type of changes needed to backfit an M-16 or M-4 rifle so that the universal mount can be put on it. The handle of the upper receiver is machined down to remove it and to form a notch that receives the rear end of the upper rail. Then a rear mount is added, and the gas block and barrel nut are replaced with a new gas block and barrel nut. The barrel and the lower receiver and the balance of the upper receiver are not affected. The advantage of these changes is that the modification is less expensive and does not jeopardize the basic integrity of the rifle.

Yet another feature of the present invention is its light weight. The addition of the present invention to a standard issue M-4 rifle results in an increase of less than 15 ounces. This light weight is of importance to a rifleman or infantryman who must carry the weapon for extensive time periods.

Other features and their advantages will become apparent to those skilled in the art from a careful reading of the Detailed Description of Preferred Embodiments as accompanied by the following drawings.

BRIEF DESCRIPTION OF THE DRAWINGS

In the drawings,

FIG. 7 is a perspective view of a heat shield for an M-16 universal mount according to a preferred embodiment of the present invention;

FIG. 8 is a perspective view of a heat shield for an M-4 universal mount according to a preferred embodiment of the present invention;

FIG. 14 is a side view of a universal mount partially positioned on a rifle according to a preferred embodiment of the present invention; and FIG. 15 is a side view of a universal mount according to a preferred embodiment of the present invention, shown with an attached optical scope and a grenade launcher suggested by dashed lines.

DETAILED DESCRIPTION OF PREFERRED EMBODIMENT

Figures 1, 2, 3:
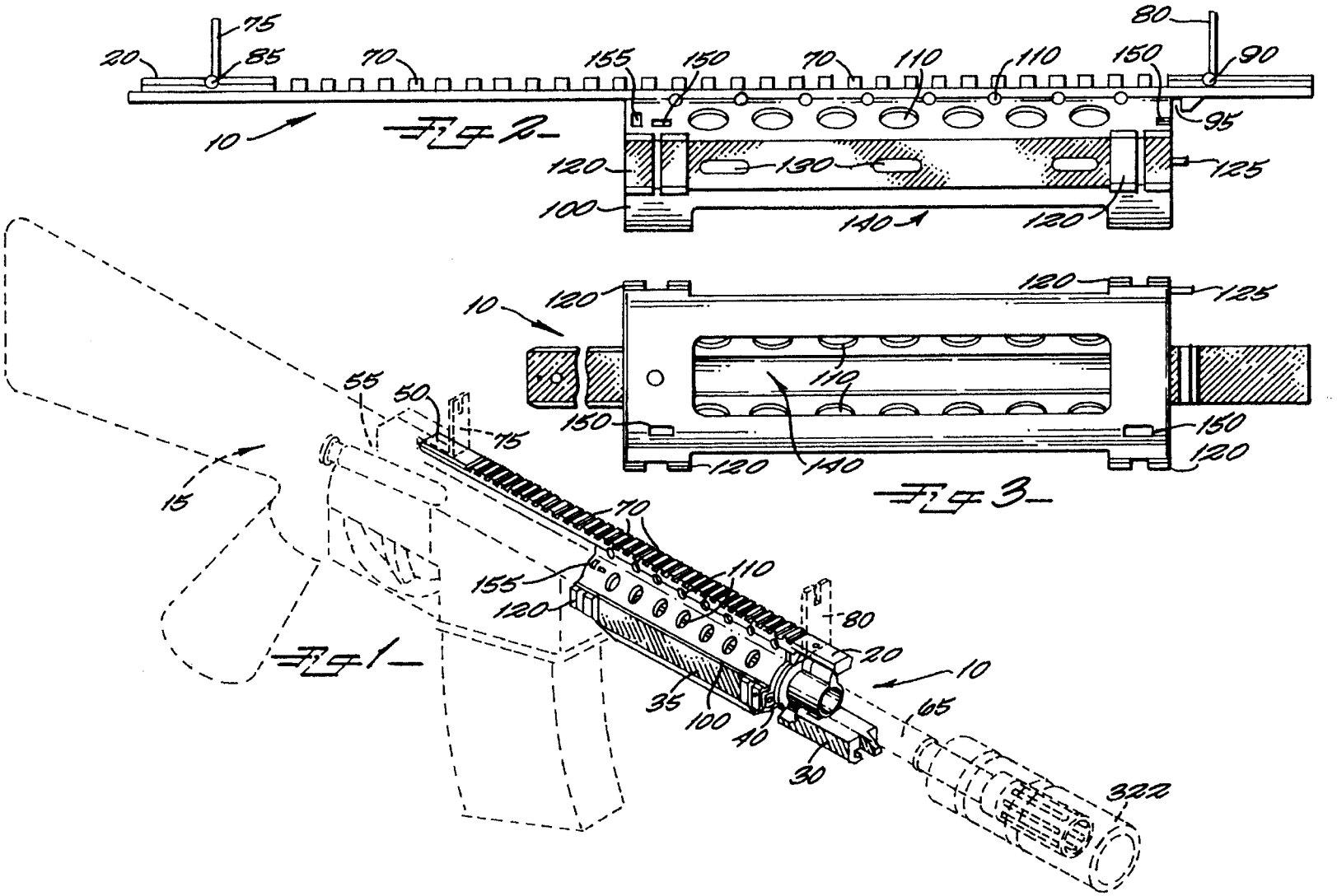
FIG. 1 is a perspective view of a universal mount according to a preferred embodiment of the present invention, shown on a rifle suggested by dashed lines.
FIG. 2 is a side view of the upper rail of a universal mount according to a preferred embodiment of the present invention.
FIG. 3 is a bottom view of the upper rail of a universal mount according to a preferred embodiment of the present invention.

The present invention is a universal mount that can be used in conjunction with an M-4 or M-16 rifle. Referring now to FIG. 1, there is shown a universal mount, according to a preferred embodiment of the present invention, generally designated by reference numeral 10, shown mounted to a rifle 15. Universal mount 10 is comprised of an upper rail 20, a lower rail 30, a heat shield 35, and semi-circular retaining clip 40. Upper rail 20, lower rail 30, and semi-circular retaining clip 40 can be made of any material that has the requisite strength, durability and corrosion resistance. Preferably, upper rail 20 and lower rail 30 are made of a lightweight aluminum alloy. Preferably, retaining clip 40 is made of steel. Heat shield 35 is preferably made of a polymeric material, although any rigid, durable material having low thermal conductivity and high temperature resistance may be used.

Universal mount 10 can be used in conjunction with an existing M-16 or M-4 by making minor changes to the weapon. Alternatively, the present invention may be incorporated into the manufacturing process of the weapon itself. When in place, universal mount 10 creates a weapons' platform that enables the marksman or rifleman to tailor the operational capabilities of the weapon to achieve a particular assignment or mission. Additionally, universal mount 10 provides a weapons' platform that will maintain the alignment of the attached sights or scopes with the barrel, despite thermal deformation caused by firing several rounds in rapid succession.

Referring now to FIG. 2 and FIG. 3, there is shown a side and bottom view, respectively, of upper rail 20. Upper rail 20 extends horizontally from a notch 50 formed in the rear of upper receiver 55 to a gas block 280 located at the muzzle end of barrel 65. Upper rail 20 contains a series of transverse ribs 70 which are spaced an equal distance apart and together form what is commonly referred to as a "Picatinny Rail." This Picatinny Rail enables the attachment of any accessory equipment that utilizes a Weaver style clamping device. Such accessory equipment includes, but is not limited to, optical scopes, night vision and infrared scopes, and laser spotters. A rear sight 75 and front sight 80 are located on upper rail 20, and each rotates about a pivot point 85 and 90, respectively. When not in use, rear sight 75 and front sight 80 are rotated about pivot points 85 and 90 to become co-planer with upper rail 20. A transverse groove 95 is located on the underside of upper rail 20, near front sight 80.

Depending from upper rail 20 and surrounding barrel 65 in spaced relation is a hand guard 100. A plurality of heat dispersing holes 110 are formed in the upper region of hand guard 100 to dissipate heat generated by barrel 65. Hand guard 100 is equipped with side mounts 120 designed to accept any accessory having a Weaver style clamp. Housed within one side mount 120 located at the muzzle end of hand guard 100 is a spring pin 125 which engages retaining clip 40. A plurality of slots 130, formed along both sides of hand guard 100, allow the attachment of heat shield 35. A throughhole 140, parallel to upper rail 20, is located at the lowermost portion of hand guard 100. Throughhole 140 provides a space through which lower rail 30 is placed into position. A pair of clearance holes 155, are located at the receiver end of hand guard 100. The interior of hand guard 100 has a series of projections 150 that matingly engage a rear mount 240 and gas block 280 of rifle 15 (shown in FIG. 9 and FIG. 11 respectively), as will be explained more fully below.

Figures 4, 5, 6, 9, 13:
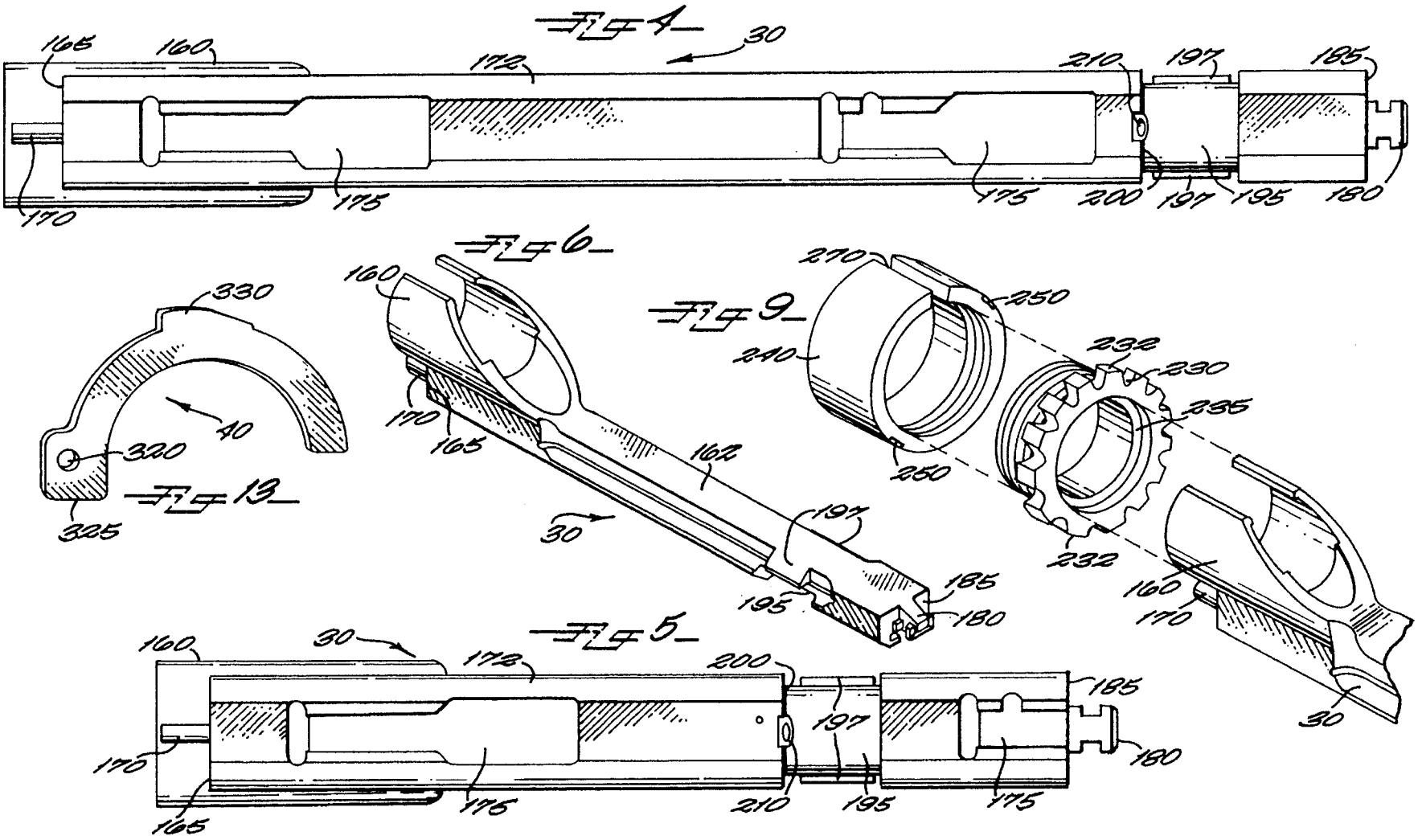
FIG. 4 is a bottom view of the lower rail for an M-16 universal mount according to a preferred embodiment of the present invention.
FIG. 5 is a bottom view of the lower rail for an M-4 universal mount according to a preferred embodiment of the present invention.
FIG. 6 is a perspective view of the lower rail for an M-4 universal mount according to a preferred embodiment of the present invention.
FIG. 9 is an exploded, perspective view of a rear mount and barrel nut according to a preferred embodiment of the present invention, with a partial view of the lower rail.
FIG. 13 is a perspective view of a retaining clip according to a preferred embodiment of the present invention.

Referring now to FIG. 4, FIG. 5 and FIG. 6, there is illustrated a bottom view of a lower rail 30 adapted to fit an M-16 rifle (FIG. 4), and a bottom and perspective view of a lower rail 30 adapted to fit an M-4 rifle (FIG. 5 and FIG. 6 respectively). Common features of these two lower rails will be labeled with the same reference numeral; however, the primary difference between the two is overall length: the M-4 lower rail is shorter. Lower rail 30 contains a collar 160 rising from top surface 162 of lower rail 30 and toward receiver end 165 of lower rail 30. Extending horizontally from receiver end 165 of lower rail 30 is a pin 170. Positioned along the length of bottom surface 172 of lower rail 30 is a pair of mounts 175 that enable the attachment of an M-203 grenade launcher, for example. A bayonet mount 180 extends horizontally from muzzle end 185 of lower rail 30. A channel 195, formed in bottom surface 172, receives hand guard 100. Located directly above channel 195 is a dovetail 197. Housed in the interior of lower rail 30 and protruding from end 200 of channel 195 is a spring pin 210. As will be explained more fully below, spring pin 210 pushes against hand guard 100 and holds lower rail 30 in position. Note that although the M-4 lower rail (FIG. 5) is shorter than the M-16 rail, the distance between mounts 175 is the same for both, since mount 175 near muzzle end 185 is forward of channel 195 in the M-4 lower rail and rearward of channel 195 in the M-16 lower rail.

Illustrated in FIG. 7 and FIG. 8 are the M-16 and M-4 versions (respectively) of heat shield 35, which serves to protect the rifleman's hand from injury as a result of heat emanating from barrel 65. Heat shield 35 is secured to the exterior of hand guard 100 by inserting projections 335, formed in the interior of heat shield 35, into slots 130 of hand guard 100. Apertures 135, formed in the bottom portion of heat shield 35, align with mounts 175 of lower rail 30 to permit the attachment of an M-203 grenade launcher.

Figures 10, 11, 12:
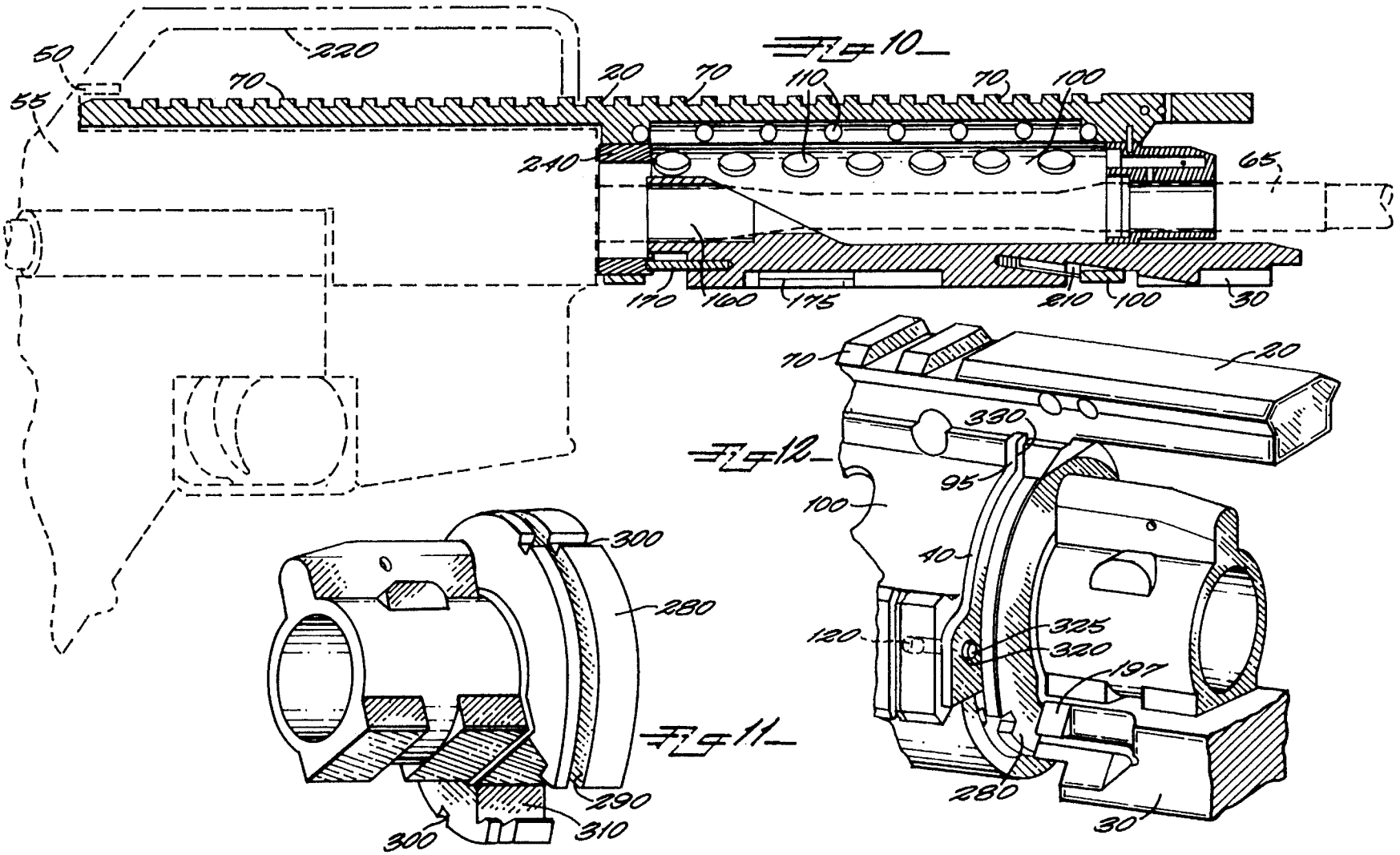
FIG. 10 is a partial, cross-sectional, side view of a universal mount according to a preferred embodiment of the present invention, shown on a portion of a rifle suggested by dashed lines.
FIG. 11 is a perspective view of a gas block according to a preferred embodiment of the present invention.
FIG. 12 is a detailed, perspective view illustrating the relationship between the upper rail, lower rail, retaining clip, and the gas block according to a preferred embodiment of the present invention.

Referring now to FIG. 9 through FIG. 11, when modifying an existing M-4 or M-16 to accept universal mount 10, the following changes are made. The existing hand guard of rifle 15 is removed. Handle 220 is then cut off, leaving only a notch 50 into which upper rail 20 is placed. The standard barrel nut and gas block are removed from the weapon. A new barrel nut 230, having a plurality of projections 232 and a counter bore 235, is placed at the receiver end of barrel 65. A mar mount 240 is then positioned, surrounding barrel nut 230. About the exterior surface of rear mount 240 am axial grooves 250. A gas tube slot 270 is located at the top of rear mount 240. The width of gas tube slot 270 is formed to be significantly larger than the diameter of the gas tube (not shown) to allow rear mount 240 to be rotated somewhat in aligning it with gas block 280. Gas block 280 has a circumferential groove 290 and a set of axial grooves 300. A channel 310, formed to accept lower rail 30, is located at the bottom of gas block 280.

To install universal mount 10 onto rifle 15, it is first necessary to achieve alignment between upper rail 20, rear mount 240 and gas block 280. At this point, rear mount 240 is free to rotate about its axis. Such alignment is accomplished using the following procedure: Upper rail 20 is slid over barrel 65 so that projections 150 within the interior of upper rail 20 are received by axial grooves 250 of mar mount 240, and axial grooves 300 of gas block 280. Thereafter rear mount 240 is pinned, through clearance holes 155 of hand guard 100, to barrel nut 230. Preferably, their is approximately a 40° angle between the pins, 20° to either side of the top center of the rear mount.

Referring now to FIG. 12 through FIG. 14, installation of universal mount 10 is achieved using the following procedure: First, upper rail 20 is slid onto barrel 65 a distance sufficient for the receiver end of hand guard 100 to clear gas block 280 but not reach rear mount 240. Lower rail 30 is then inserted through throughhole 140, with collar 160 wrapping around barrel 65. Lower rail 30 is then moved toward rear mount 240 until collar 160 is flush against counter bore 235 of barrel nut 230 and pin 170 is between the two lowest projections 232 of barrel nut 230. Upper rail 20 is then moved toward receiver 55 until received by notch 50. At such time, hand guard 100 will be seated on rear mount 240 and gas block 280, while dovetail 197 of lower rail 30 will be positioned within channel 310 of gas block 280, with spring pin 210 in position against hand guard 100. The diameter of spring pin 210 is preferably less than or equal to the thickness of hand guard 100 and there is therefore full diameter engagement of spring pin 210 against hand guard 100. Semi-circular retaining clip 40 is then placed in circumferential groove 290 of gas block 280 and rotated until spring pin 125 engages hole 320 of ear 325 and lip 330 resides within groove 95, as shown in FIGS. 12 and 13. Thereafter, heat shield 35 is then placed on hand guard 100 by inserting projections 335 within slots 130.

It is to be appreciated that the various components of the present invention act in concert to provide a secure universal mount. The rotation of hand guard 100 is prevented by the engagement of projections 150 and grooves 250 in rear mount 240 and gas block 280, respectively, while forward movement is prohibited by retaining clip 40 engaging spring pin 125. The engagement of upper rail 20 with notch 50 acts to prevent its upward movement. Similarly, collar 160 abuts counter bore 235 as a result of the force imparted by spring pin 210 to prevent lateral movement of lower rail 30, while rotational movement is prohibited by pin 170 residing between the projections of barrel nut 230 and dovetail 197 residing within channel 310.

When in position, universal mount 10 creates a weapons' platform, that preserves and maintains the line of sight of any attached scoping or sighting devices and the direction of the barrel. The attachment of hand guard 100 to gas block 280 permits universal mount 10 to move in the same direction with barrel 65 as the latter undergoes thermal deformation as a result of intense use. It is recognized that upper rail 20 fits within notch 50 but is not fastened thereto by any means. Consequently, upper rail 20 is allowed to move slightly in order to maintain the alignment between the attached devices and barrel 65 of rifle 15. As shown in FIG. 15, universal mount 10 is shown supporting an optical scope 340 and grenade launcher 345.

Optionally, the accuracy of a weapon having universal mount 10 attached thereto can be enhanced further by the attachment of a ballistic optimizing system 322 (shown attached to barrel 65 in FIG. 1); commonly referred to as a "BOSS" and which is described in U.S. Pat. No. 5,279,200, incorporated herein by reference. The BOSS provides an axially movable weight affixed to the muzzle of the barrel. By moving the weight toward or away from the muzzle, the effective center of gravity of the barrel is changed. Consequently, it is possible to dampen vibrations of the barrel while minimizing travel deflection of the ammunition. Adding a BOSS to a rifle equipped with a universal mount 10 results in a weapon having enhanced accuracy and operational capabilities that preserves the coincidence between where the rifle is aimed and where the bullet goes when fired.

It will be apparent to those skilled in the art that many modifications and substitutions can be made to the preferred embodiment just described without departing from the spirit and scope of the invention as defined in the appended claims.

What is claimed is:

1. A universal mount for supporting at least one accessory device, said mount for use with a rifle, said rifle having an upper receiver, a gas block, a rear mount and a barrel nut, said upper receiver having a notch formed thereon, said barrel nut having a counter bore and a plurality of projections, said universal comprising:

an upper rail having a receiver end and an opposing muzzle end, said upper rail extending from the rear of said upper receiver of said rifle to said gas block of said rifle, said upper rail having a top surface and a bottom surface, said upper rail having a notch formed in said bottom surface and proximate to said muzzle end;

a hand guard attached to said upper rail, said hand guard having opposing sides and a bottom portion, said hand guard surrounding said barrel of said rifle in spaced relation and attached to said rear mount and said gas block of said rifle, said hand guard having a plurality of heat dissipating holes formed along said opposing sides, said hand guard having a throughhole formed along said bottom surface, said hand guard having a plurality of side mounts extending therefrom;

a lower rail positioned between said barrel of said rifle and said bottom surface of said hand guard, said lower rail having a receiver end and a muzzle end, a top surface and a bottom surface, said lower rail having a pair of mounts formed in said bottom surface for receiving a grenade launcher, said lower rail having a channel formed along said bottom surface, said channel receiving said bottom portion of said hand guard;

a semi-circular retaining clip, said retaining clip received by said gas block of said rifle and within said notch of said upper rail to hold said upper rail to said gas block of said rifle; and a heat shield attached to said hand guard, said heat shield having a bottom portion, said heat shield having at least one aperture formed in said bottom portion, said at least one aperture being aligned with at least one mount of said pair of mounts of said lower rail.

2. The universal mount as recited in claim 1, wherein said top surface of said upper rail further comprises a plurality of equally spaced, transverse ribs extending therefrom, said top surface of said upper rail having a rear sight and a front sight, said rear sight pivoting about a pivot point, said rear sight positioned proximate to said receiver end of said upper rail, said front sight pivoting about a pivot point, said front sight positioned proximate to said muzzle end of said upper rail.

3. The universal mount as recited in claim 1, wherein said gas block of said rifle has a circumferential groove, wherein said retaining clip further comprises an ear extending therefrom, said ear having a hole formed therethrough, said hand guard having a spring pin housed in one side mount of said plurality of said side mounts, said hole formed in said ear of said retaining clip receiving said spring pin in said one side mount when said retaining clip is rotated in said circumferential groove of said gas block.

4. The universal mount as recited in claim 1, wherein said lower rail further comprises a collar extending from said top surface of said lower rail and beyond said muzzle end of said lower rail and a pin extending horizontally from said muzzle end of said lower rail, said collar residing within said counter bore of said barrel nut of said rifle, said pin being positioned between the two lowermost projections of said plurality of projections of said barrel nut, said lower rail having a bayonet mount extending horizontally from said muzzle end.

5. The universal mount as recited in claim 1, wherein said lower rail further comprises a spring pin housed therein, said spring pin engaging said hand guard when said hand guard is placed within said channel of said lower rail.

6. The universal mount as recited in claim 1, wherein said upper rail, said lower rail and said hand guard are made of a lightweight aluminum alloy, said retaining clip is made of steel and said heat shield is made of a polymer.

7. The universal mount as recited in claim 1, wherein said receiver end of said upper rail is received by said notch in said upper receiver of said rifle.

8. A weapon comprising:

a rifle comprising an upper receiver having a notch formed thereon, a barrel having a receiver end and an opposing muzzle end, a gas block affixed to said barrel proximate to said muzzle end, said gas block having a circumferential groove and a channel formed in the lowermost portion, a barrel nut affixed to said receiver end of said barrel, said barrel nut having a plurality of projections and a counter bore, and a rear mount surrounding said barrel nut, said rear mount having an outer surface, said outer surface having a gas tube slot formed therethrough, a universal mount comprising:

an upper rail having a receiver end and an opposing muzzle end, said upper rail extending horizontally from the rear of said upper receiver of said rifle to said gas block of said rifle, said upper rail having a top surface and a bottom surface, said upper rail having a notch formed in said bottom surface and proximate to said muzzle end, a hand guard attached to said upper rail, said hand guard having opposing sides, an interior, a receiver end and a muzzle end, said hand guard surrounding said barrel of said rifle in spaced relation, said receiver end of said hand guard engaging said rear mount, said muzzle end of said hand guard engaging said gas block, said hand guard having a plurality of heat dissipating holes formed along said opposing sides, said hand guard having a throughhole formed along said bottom surface, said hand guard having a plurality of side mounts extending therefrom, a lower rail positioned between said barrel of said rifle and said bottom surface of said hand guard, said lower rail having a receiver end and a muzzle end, a top surface and a bottom surface, said lower rail having a pair of mounts formed on said bottom surface for receiving a grenade launcher, said lower rail being received by said channel in said gas block, said lower rail having a channel formed along said bottom surface, said channel of said lower rail receiving said bottom portion of said hand guard, a semi-circular retaining clip, said retaining clip received by said gas block of said rifle and within said notch of said upper rail to hold said upper rail to said gas block, and a heat shield attached to said hand guard, said heat shield having a bottom portion, said heat shield having at least one aperture formed in said bottom portion, said at least one aperture being in alignment with at least one mount of said pair of mounts of said lower rail.

9. The weapon as recited in claim 8, wherein said top surface of said upper rail further comprises a plurality of equally spaced, transverse ribs extending therefrom, said top surface of said upper rail having a rear sight and a front sight, said rear sight pivoting about a pivot point, said rear sight positioned proximate to said receiver end of said upper rail, said front sight pivoting about a pivot point, said front sight positioned proximate to said muzzle end of said upper rail.

10. The weapon as recited in claim 8, wherein said retaining clip further comprises an ear extending therefrom, said ear having a hole formed therethrough, said hand guard having a spring pin housed in one side mount of said plurality of said side mounts, said hole formed in said ear of retaining clip receiving said spring pin in said one side mount when said retaining clip is rotated in said circumferential groove of said gas block.

11. The weapon as recited in claim 8, wherein said lower rail further comprises a collar extending from said top surface of said lower rail and beyond said muzzle end of said lower rail and a pin extending horizontally from said muzzle end of said lower rail, said collar residing within said counter bore of said barrel nut of said rifle, said pin being positioned between the two lowermost projections of said plurality of projections of said barrel nut, said lower rail having a bayonet mount extending horizontally from said muzzle end.

12. The weapon as recited in claim 8, wherein said lower rail further comprises a spring pin housed therein, said spring pin engaging said hand guard when said hand guard is placed within said channel of said lower rail.

13. The mount as recited in claim 8, wherein said upper rail, said lower rail and said hand guard are made of a lightweight aluminum alloy, said retaining clip is made of steel and said heat shield is made of a polymer.

14. The weapon as recited in claim 8, wherein said receiver end of said upper rail is received by said notch in said upper receiver of said rifle.

15. A weapon comprising:

a rifle comprising an upper receiver having a notch formed thereon, a barrel having a receiver end and an opposing muzzle end, a gas block affixed to said barrel proximate to said muzzle end, said gas block having a circumferential groove and a channel formed in the lowermost portion, a barrel nut affixed to said receiver end of said barrel, said barrel nut having a plurality of projections and a counter bore, and a rear mount surrounding said barrel nut, said rear mount having an outer surface, said outer surface having a gas tube slot formed therethrough, a universal mount comprising an upper rail having a receiver end and an opposing muzzle end, said upper rail extending horizontally from the rear of said upper receiver of said rifle to said gas block of said rifle, said upper rail having a top surface and a bottom surface, said upper rail having a notch formed in said bottom surface and proximate to said muzzle end, a hand guard attached to said upper rail, said hand guard having opposing sides, an interior, a receiver end and a muzzle end, said hand guard surrounding said barrel of said rifle in spaced relation, said receiver end of said hand guard engaging said rear mount, said muzzle end of said hand guard engaging said gas block, said hand guard having a plurality of heat dissipating holes formed along said opposing sides, said hand guard having a throughhole formed along said bottom surface, said hand guard having a plurality of side mounts extending therefrom, a lower rail positioned between said barrel of said rifle and said bottom surface of said hand guard, said lower rail having a receiver end and a muzzle end, a top surface and a bottom surface, said lower rail having a pair of mounts formed on said bottom surface for receiving a grenade launcher, said lower rail being received by said channel in said gas block, said lower rail having a channel formed along said bottom surface, said channel of said lower rail receiving said bottom portion of said hand guard, a semi-circular retaining clip, said retaining clip received by said gas block of said rifle and within said notch of said upper rail to hold said upper rail to said gas block, and a heat shield attached to said hand guard, said heat shield having a bottom portion, said heat shield having at least one aperture formed in said bottom portion, said at least one aperture being in alignment with at least one mount of said pair of mounts of said lower rail, a ballistic optimizing system, said ballistic optimizing system attached to said muzzle end of said barrel of said rifle.

16. The weapon as recited in claim 15, wherein said top surface of upper rail further comprises a plurality of equally spaced, transverse ribs extending therefrom, said top surface of said upper rail having a rear sight and a front sight, said rear sight pivoting about a pivot point, said rear sight positioned proximate to said receiver end of said upper rail, said from sight pivoting about a pivot point, said front sight positioned proximate to said muzzle end of said upper rail.

17. The weapon as recited in claim 15, wherein said retaining clip further comprises an ear extending therefrom, said ear having a hole formed therethrough, said hand guard having a spring pin housed in one side mount of said plurality of said side mounts, said hole formed in said ear of said retaining clip receiving said spring pin in said one side mount when said retaining clip is rotated in said circumferential groove of said gas block.

18. The weapon as recited in claim 15, wherein said lower rail further comprises a collar extending from said top surface of said lower rail and beyond said muzzle end of said lower rail and a pin extending horizontally from said muzzle end of said lower rail, said collar residing within said counter bore of said barrel nut of said rifle, said pin being positioned between the two lowermost projections of said plurality of projections of said barrel nut, said lower rail having a bayonet mount extending horizontally from said muzzle end.

19. The weapon as recited in claim 15, wherein said lower rail further comprises a spring pin housed therein, said spring pin engaging said hand guard when said hand guard is placed within said channel of said lower rail.

20. The mount as recited in claim 15, wherein said upper rail, said lower rail and said hand guard are made of a lightweight aluminum alloy, said retaining clip is made of steel and said heat shield is made of a polymer.

21. The weapon as recited in claim 15, wherein said receiver end of said upper rail is received by said notch in said upper receiver of said rifle.

* * * * *